US009282398B2

(12) United States Patent
Monroe

(10) Patent No.: US 9,282,398 B2
(45) Date of Patent: Mar. 8, 2016

(54) SPEAKER SYSTEM HAVING WIDE BANDWIDTH AND WIDE HIGH-FREQUENCY DISPERSION

(71) Applicant: Dana Monroe, Portland, OR (US)

(72) Inventor: Dana Monroe, Portland, OR (US)

( * ) Notice: Subject to any disclaimer, the term of this patent is extended or adjusted under 35 U.S.C. 154(b) by 114 days.

(21) Appl. No.: 14/219,656

(22) Filed: Mar. 19, 2014

(65) Prior Publication Data

US 2015/0271591 A1 Sep. 24, 2015

(51) Int. Cl.
*H04R 1/20* (2006.01)
*H04R 1/22* (2006.01)

(52) U.S. Cl.
CPC ..... *H04R 1/22* (2013.01)

(58) Field of Classification Search
None
See application file for complete search history.

(56) References Cited

U.S. PATENT DOCUMENTS

| | | | | |
|---|---|---|---|---|
| 3,299,206 | A | 1/1967 | Klepper | |
| 3,867,996 | A | 2/1975 | Lou | |
| 4,776,428 | A * | 10/1988 | Belisle | G10K 11/025 181/152 |
| 4,870,691 | A | 9/1989 | Mindel | |
| 5,115,883 | A | 5/1992 | Morikawa et al. | |
| 5,117,463 | A | 5/1992 | Oyaba et al. | |
| 5,163,167 | A | 11/1992 | Heil | |
| 5,900,593 | A | 5/1999 | Adamson | |
| 6,112,847 | A | 9/2000 | Lehman | |
| 6,668,969 | B2 | 12/2003 | Meyer et al. | |
| 6,744,899 | B1 * | 6/2004 | Grunberg | H04R 1/30 381/340 |
| 7,134,523 | B2 | 11/2006 | Engebretson | |
| 7,177,437 | B1 | 2/2007 | Adams | |
| 7,278,513 | B2 | 10/2007 | Brawley, Jr. | |
| 7,624,839 | B1 | 12/2009 | Graber | |
| 7,631,724 | B2 | 12/2009 | Onishi | |
| 7,650,006 | B2 | 1/2010 | Isotalo | |
| 7,735,599 | B2 | 6/2010 | Kubota | |
| 8,130,994 | B2 | 3/2012 | Button et al. | |
| 8,290,195 | B2 | 10/2012 | Chick et al. | |
| 2002/0114482 | A1 * | 8/2002 | Adamson | H04R 1/26 381/340 |
| 2006/0034475 | A1 * | 2/2006 | Geddes | H04R 1/345 381/343 |

* cited by examiner

*Primary Examiner* — Thang Tran
(74) *Attorney, Agent, or Firm* — Joseph P. Curtin, L.L.C.

(57) ABSTRACT

A speaker system comprises a speaker transducer, a diffraction-slot acoustic waveguide and first and second mechanical acoustic barriers. The waveguide is arranged in proximity to the speaker transducer along a centerline of the speaker transducer so that the waveguide extends substantially an equal distance on both sides of the centerline of the speaker transducer. The area of the waveguide covers a corresponding area of the speaker transducer. The first and second mechanical acoustic barriers are respectively disposed on each side of the waveguide and cover the areas of the speaker transducer on both sides of the centerline of the speaker transducer that are not covered by the waveguide. The first and second mechanical acoustic barriers provide a low-pass filter for acoustic energy output from the speaker transducer.

20 Claims, 7 Drawing Sheets

SPEAKER SYSTEM HAVING WIDE BANDWIDTH AND WIDE HIGH-FREQUENCY DISPERSION

BACKGROUND

The subject matter disclosed herein generally relates to speaker systems. More specifically, the subject matter disclosed herein relates to a speaker system having a wide audio bandwidth and a wide high-frequency dispersion.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

Figure 1A:
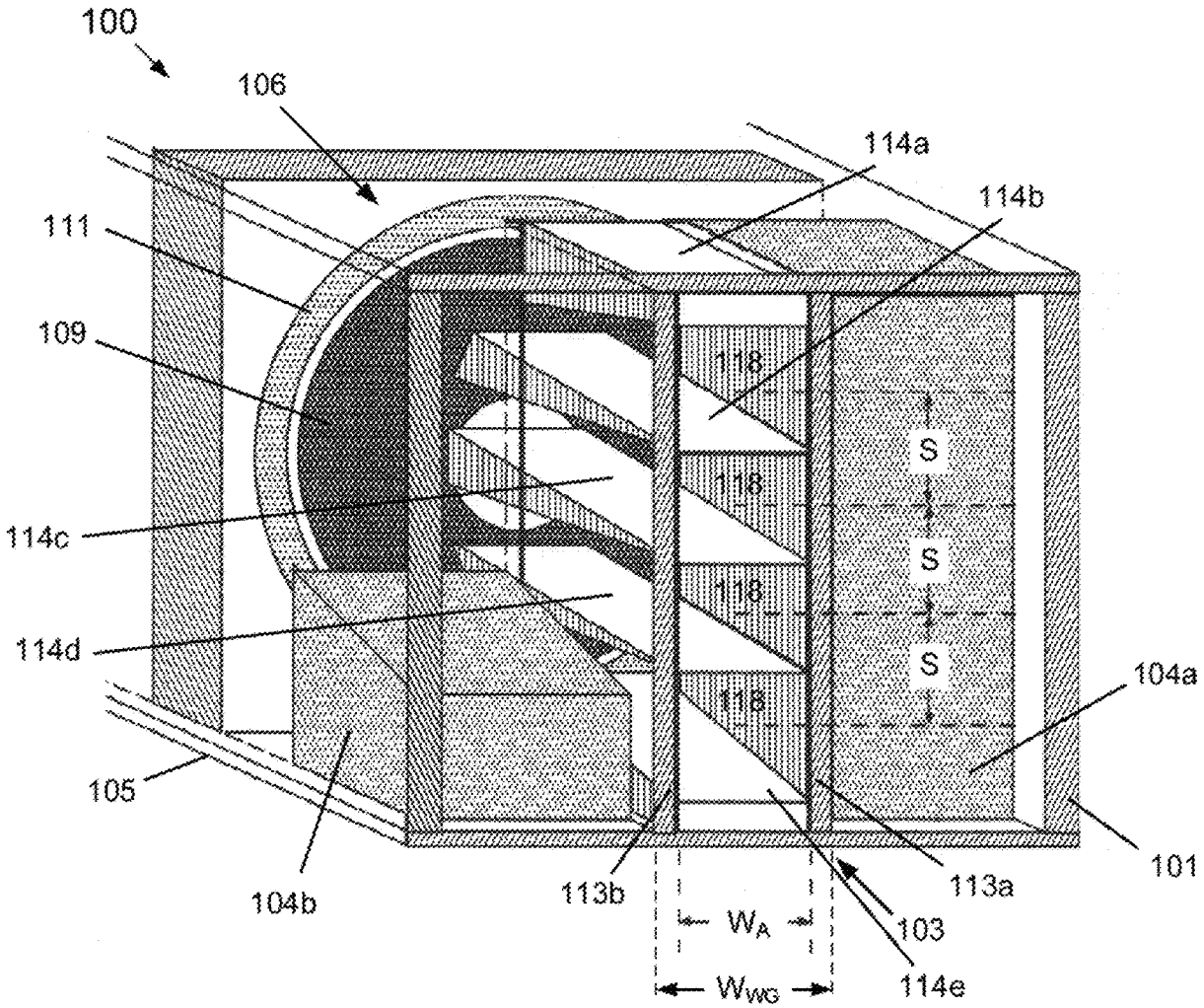
FIGS. 1A-1E depict various views of an exemplary embodiment of a speaker system according to the subject matter disclosed herein.

As used herein, the word "exemplary" means "serving as an example, instance, or illustration." Any embodiment described herein as "exemplary" is not to be construed as necessarily preferred or advantageous over other embodiments. Additionally, it will be appreciated that for simplicity and/or clarity of illustration, elements illustrated in the figures have not necessarily been drawn to scale. For example, the dimensions of some of the elements may be exaggerated relative to other elements for illustrative clarity. Further, in some figures only one or two of a plurality of similar elements indicated by reference characters for illustrative clarity of the figure, whereas all of the similar element may not be indicated by reference characters. Further still, it should be understood that although some portions of components and/or elements of the subject matter disclosed herein have been omitted from the figures for illustrative clarity, good engineering, construction and assembly practices are intended.

Exemplary embodiments of the subject matter disclosed herein provide a speaker system comprising a wide audio bandwidth and a wide high-frequency dispersion. Additionally, exemplary embodiments of the subject matter disclosed herein could utilize relatively larger speaker transducers (drivers) for more "low end," and are cost effective and relatively light weight because tweeters and high-frequency drivers are not needed. Accordingly, speaker systems according to the subject matter disclosed herein are suitable for general-purpose low- and medium-power public-address (PA) systems, such as, but not limited to coplanar line arrays in straight, or curved arrays. Additionally, speaker systems according to the subject matter disclosed herein are suitable for high-fidelity home stereo systems.

One exemplary embodiment of the subject matter disclosed herein provides speaker system comprising a speaker transducer, a diffraction-slot acoustic waveguide, and first and second mechanical acoustic barriers. The speaker transducer comprising a diameter and a vertically oriented centerline. The diffraction-slot acoustic waveguide comprises a first side, a second side, a third side and a fourth side. The first and second sides each comprises a first length and extend in a first direction that is substantially parallel to the centerline of the speaker transducer. The first and second sides are arranged to be opposite from each other. The third and fourth sides each comprise a second length and extend in a second direction that is substantially perpendicular to the centerline of the speaker transducer. The third and fourth sides are arranged to be opposite from each other. An area of the waveguide is defined by the first length and the second length, and the waveguide is arranged in proximity to the speaker transducer along the centerline of the speaker transducer so that the third and fourth sides extend substantially an equal distance on both sides of the centerline of the speaker transducer. The area of the waveguide covers a corresponding area of the speaker transducer. The first and second mechanical acoustic barriers each comprise a length, a width and an area defined by the length and the width of the mechanical acoustic barrier. The length of each mechanical acoustic barrier extends in the first direction and the width of each mechanical barrier extends in the second direction. The first mechanical acoustic barrier is disposed adjacent to the first side of the waveguide so that the length of the first mechanical acoustic barrier corresponds to the length of the first side. The second mechanical acoustic barrier is disposed adjacent to the second side of the waveguide so that the length of the second mechanical acoustic barrier corresponds to the length of the second side. The respective areas of the first and second mechanical acoustic barriers cover areas of the speaker transducer on both sides of the centerline of the speaker transducer that are not covered by the waveguide. The first and second mechanical acoustic barriers provide a low-pass filter for acoustic energy output from the speaker transducer. In one exemplary embodiment, the waveguide further comprises a third length that extends in a third direction away from the speaker transducer such that the third direction is substantially perpendicular to the first and second directions, and such that the third length of the waveguide is greater than or equal to one half of the quantity of the speaker transducer diameter minus the second length. In one exemplary embodiment, the third length of the waveguide is greater than or equal to about 1½ inches. In one exemplary embodiment, the diameter of the speaker transducer comprises about 4 inches, and in one exemplary embodiment, wherein the first and second mechanical acoustic barriers each comprise a foam material comprising between about 60 pores per inch (ppi) and about 120 ppi. One exemplary embodiment provides a plurality of speaker systems stacked on top of each other to form a line array.

One exemplary embodiment of the subject matter disclosed herein provides a speaker system comprising an enclosure, a speaker transducer, a waveguide and at least two mechanical acoustic barriers. The waveguide comprises two side walls and a plurality of directing fins that extend between the two side walls, thereby forming an acoustic waveguide structure. Input and output apertures of the waveguide are arranged along a longitudinal axis of the waveguide. The input apertures are arranged in close proximity to the diaphragm of the speaker transducer. The output apertures of the waveguide comprise openings that are substantially orthogonal to the longitudinal axis and a transverse axis of the waveguide. In one exemplary embodiment, the input and the output apertures are both arranged substantially along a vertical centerline of the speaker transducer. In one exemplary embodiment, both the input and output apertures comprise a substantially square or rectangular shape, but are not so limited in shape. A width of the waveguide (e.g., along the transverse axis) is selected so that the waveguide partially covers the total area of the speaker transducer. The mechanical acoustic barriers are disposed on each side of the waveguide and cover the remaining areas of the speaker transducer. The acoustic mechanical barriers provide a low-pass filter for acoustic energy output from the speaker transducer.

A speaker system according to the subject matter disclosed herein can be scaled in size based on the size of the speaker transducer with a waveguide that is also scaled vertically, such has a relatively short aperture-to-aperture spacing and with mechanical acoustic barriers disposed on each side of the waveguide.

Figure 1B:
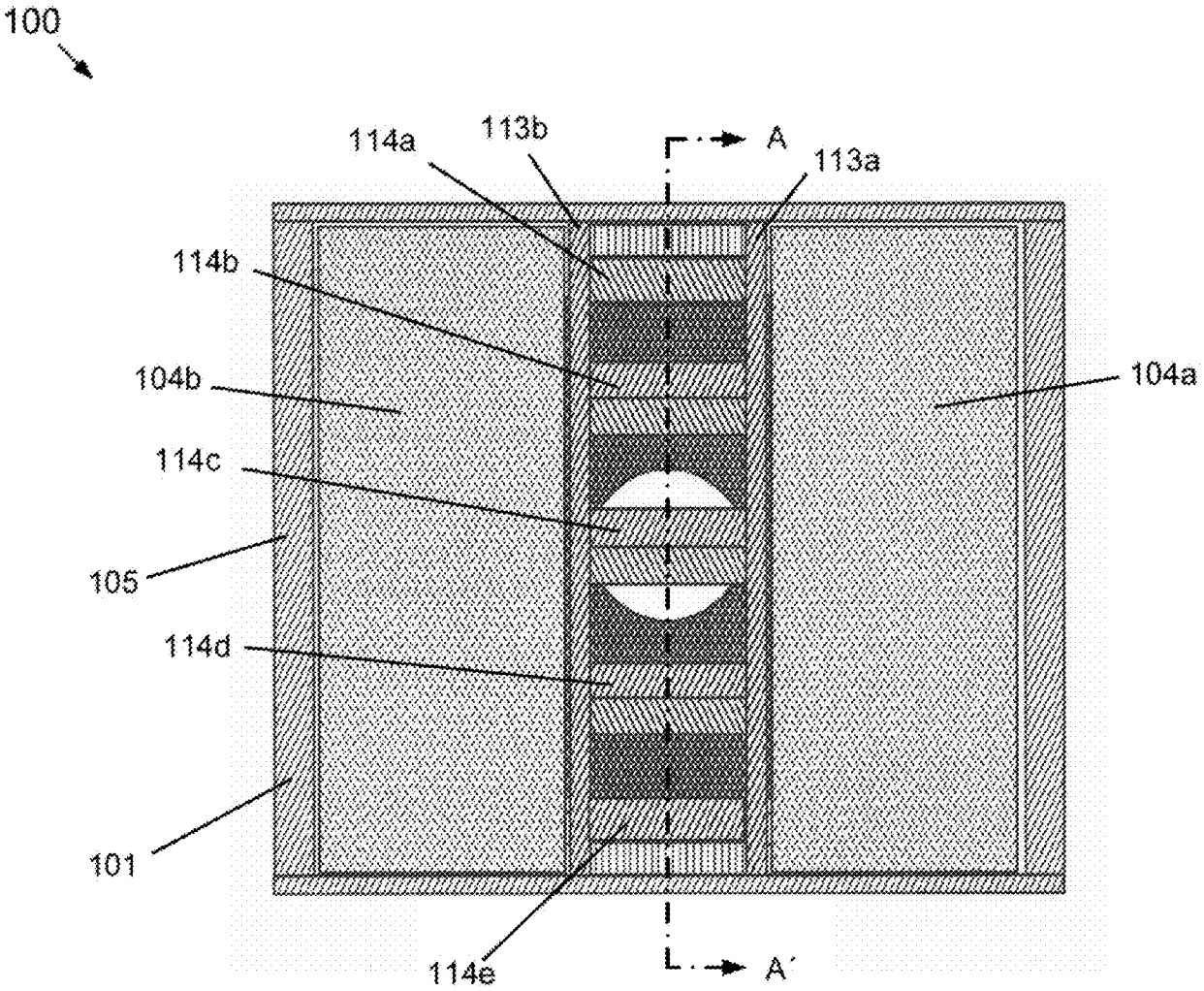
Figure 1C:
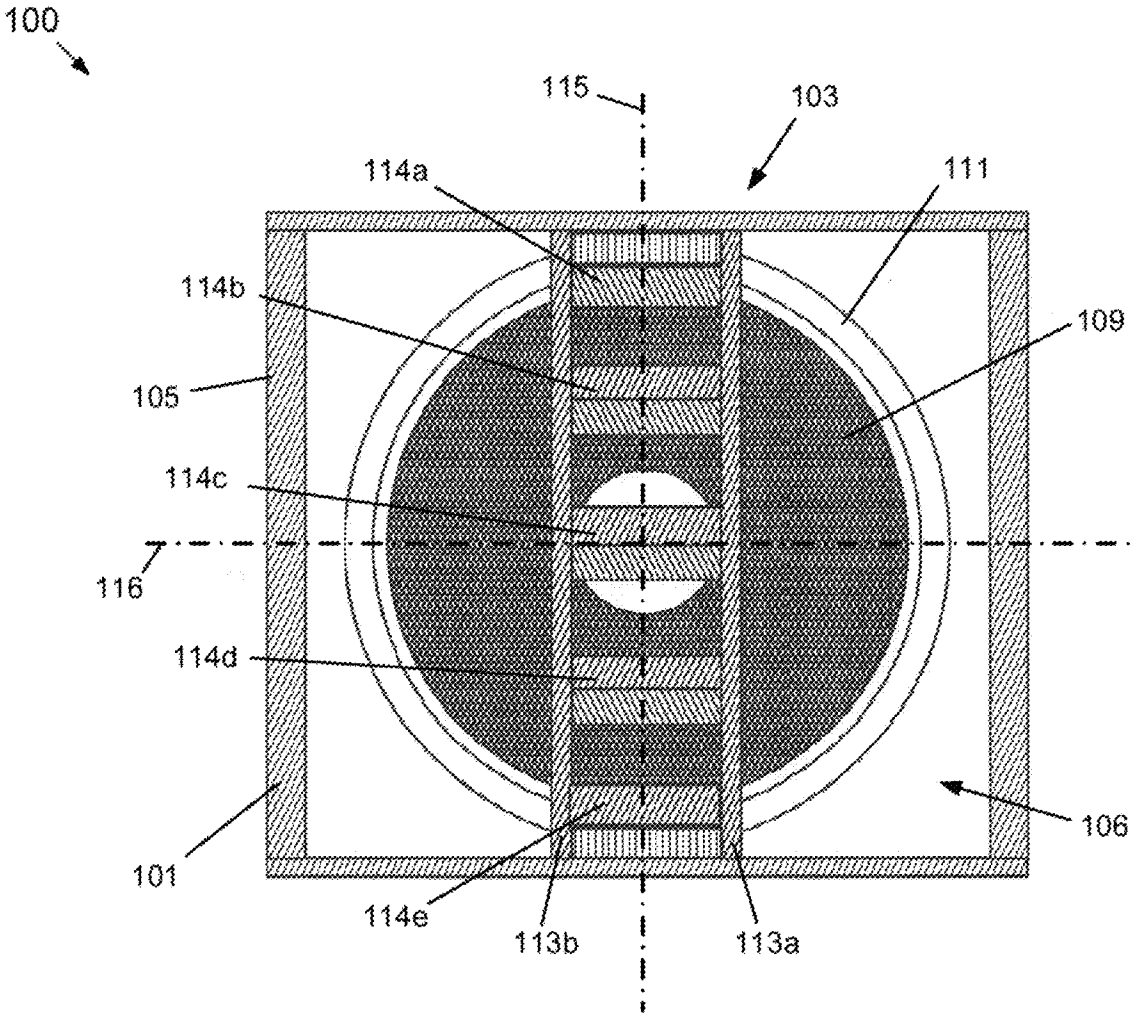
Figure 1D:
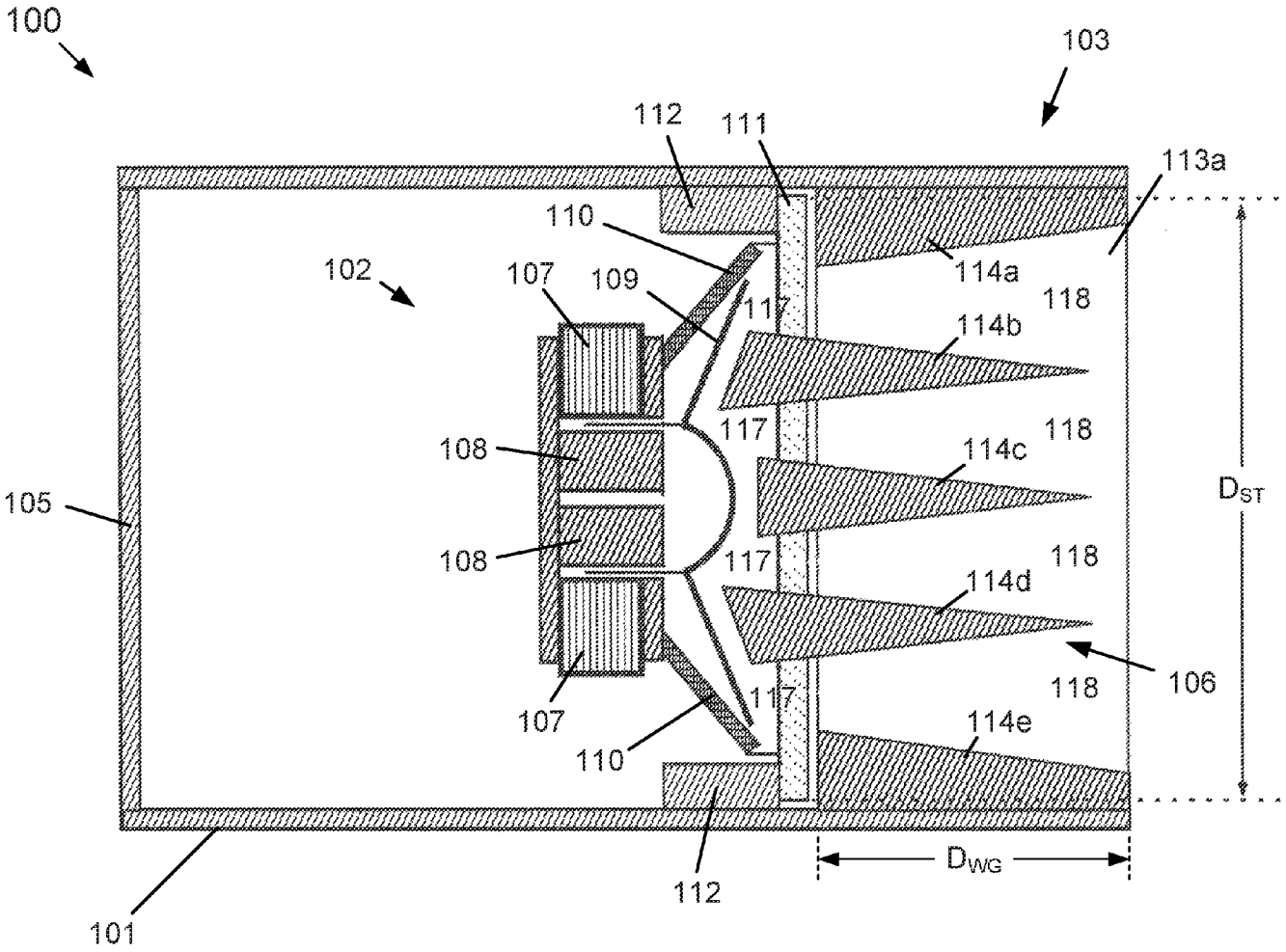
Figure 1E:
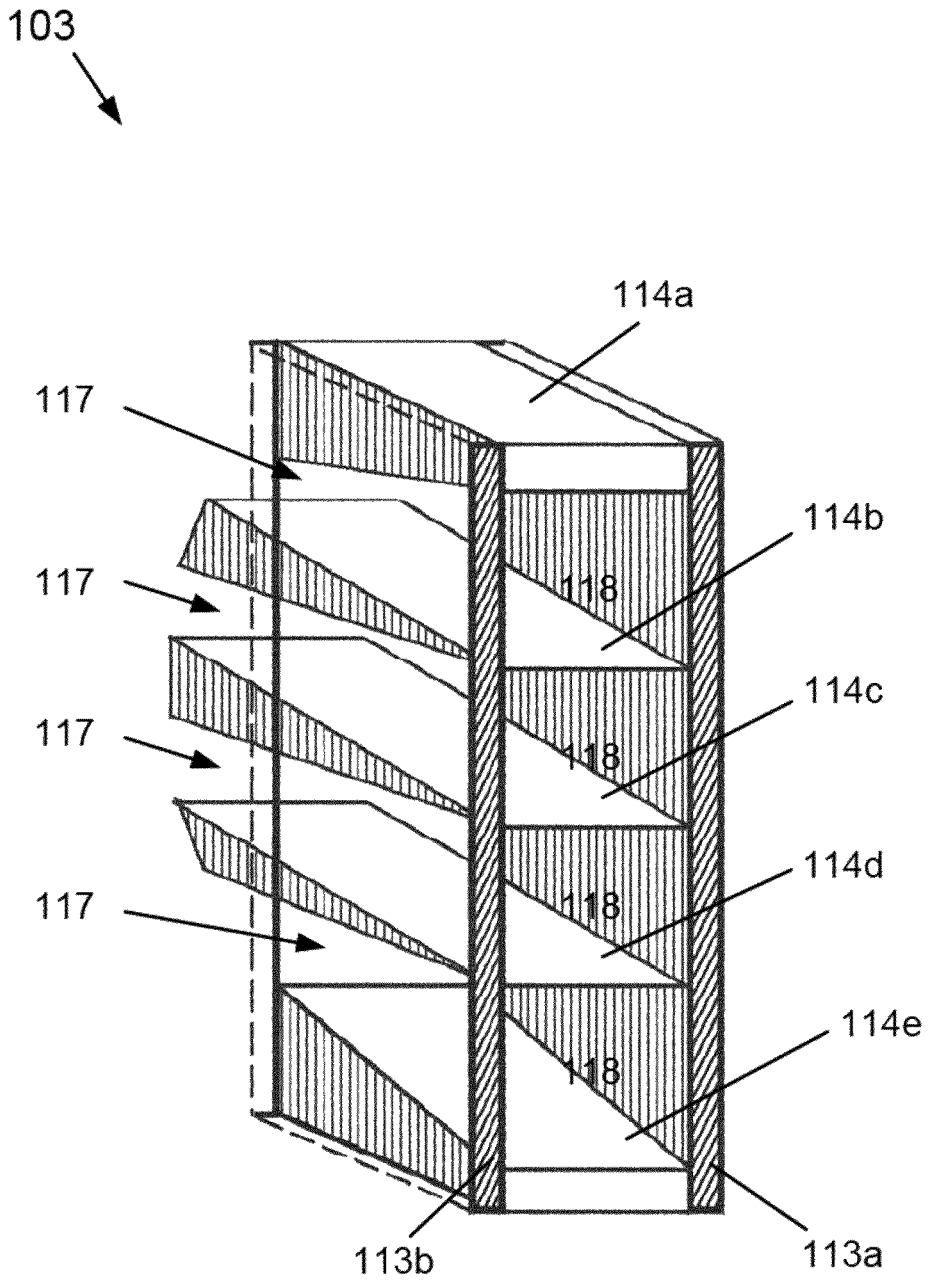

FIG. 1A depicts an axonometric front view of an exemplary embodiment of a speaker system 100 according to the subject matter disclosed herein. FIG. 1B depicts a front view of the exemplary embodiment of speaker system 100. FIG. 1C depicts the front view of the exemplary embodiment of speaker system 100 in which the mechanical barriers are not shown. FIG. 1D depicts a side cross-sectional view of the exemplary embodiment of speaker system 100 taken along line A-A' in FIG. 1B. FIG. 1E depicts an axonometric front view of an exemplary embodiment of an acoustic waveguide 103 according to the subject matter disclosed herein.

Referring to FIGS. 1A-1E, speaker system 100 comprises an enclosure 101, a speaker transducer 102, an acoustic waveguide 103, and mechanical acoustic barriers 104*a* and 104*b*. Enclosure 101 comprises a cabinet 105 into which speaker transducer 102 is mounted and a mouth area 106 that is adapted to receive waveguide 103 and mechanical acoustic barriers 104*a* and 104*b*. It should be noted that in FIGS. 1A and 1E, some parts of speaker system 100 are depicted as phantom to better depict the exemplary embodiment of speaker system 100. In particular in FIG. 1A, a left sidewall of cabinet 105 and waveguide side wall 113*b* are depicted in phantom. Additionally, only a portion of mechanical acoustic barrier 104*b* is shown in FIG. 1A. In FIG. 1E, waveguide side wall 113*b* is depicted in phantom.

In one exemplary embodiment, speaker transducer 102 comprises a magnet 107, a voice coil 108, a transducer diaphragm 109, a transducer frame 110, and a mounting ring 111. Mounting ring 111 is used for mounting speaker transducer 102 to a mounting baffle 112 in enclosure 101. It should be understood that other alternative embodiments of speaker transducer 102 are possible. In one exemplary embodiment, speaker transducer 102 comprises an audio bandwidth of about 100 Hz to about 18 kHz. Other bandwidths are possible for speaker transducer 102. For example, the audio bandwidth could range from about 60 Hz to 18 kHz depending on the design limitations of speaker transducer 102.

One exemplary embodiment of waveguide 103 comprises a diffraction-slot acoustic waveguide. Waveguide 103 comprises sidewalls 113*a* and 113*b* and a plurality of waveguide directing fins 114*a*-114*e*. Directing fins 114*a*-114*e* extend between sidewalls 113*a* and 113*b*, thereby forming a waveguide structure having a dimension along a longitudinal axis 115 (FIG. 1C) of the waveguide assembly 103 that is relatively larger than a dimension along a transverse axis 116 (FIG. 1C). Input apertures 117 and output apertures 118 are formed by the side walls 113*a* and 113*b* and directing fins 114*a*-114*e*. Input apertures 117 and output apertures 118 are arranged along a longitudinal axis 115 and respectively have openings that are substantially parallel to a plane formed by longitudinal axis 115 and a transverse axis 116. In one exemplary embodiment, the input apertures 117 and the output apertures 118 both comprise a substantially square or a rectangular shape, although the claimed subject matter is not so limited. Waveguide 103 positioned within mouth area 106 of enclosure 101 and is disposed with respect to speaker transducer 102 so that input apertures 117 are in close proximity to speaker transducer 102.

Longitudinal axis 115 of waveguide assembly 103 is disposed with respect to speaker transducer 102 substantially along a vertical centerline of the speaker transducer. That is, the longitudinal axis 115 of the waveguide assembly is positioned within a mouth area 106 of enclosure 101 substantially centered horizontally with respect to speaker transducer 102.

In one exemplary embodiment of speaker system 100, speaker transducer 102 comprises a diameter $D_{ST}$ (FIG. 1D) of about 4", a spacing S (FIG. 1A) of the centers of output apertures 118 of about 0.75" apart, and an output aperture width $W_A$ (FIG. 1A) of less than or equal to about 1". It should be understood that other speaker transducers could be used that have a different diameter, such as, but not limited to, a diameter $D_{ST}$ of about 3" to about 10". Additionally, the centers of output apertures 118 could have a different spacing, for example, equal to or less than about 0.875". In exemplary embodiments in which larger diameter speaker transducers are used, the audio bandwidth could range to be as low as about 60 Hz.

In one exemplary embodiment, waveguide 103 comprises a depth $D_{WG}$ (FIG. 1D)extending away from speaker transducer 102, and has a width $W_{WG}$ that will vary dependingon the thickness of sidewalls 113*a* and 113*b*. In one exemplary embodiment, the depth $D_{WG}$ of waveguide 103 is greater than or equal to about 1.5". In another exemplary embodiment, the depth $D_{WG}$ of waveguide 103 is selected to be greater than or equal to $\frac{1}{2}(D_{ST}-D_{WG})$.

In one exemplary embodiment, mechanical acoustic barriers 104*a* and 104*b* comprise a foam material that provides a low-pass filtering of the acoustic energy output from speaker transducer 102. In one exemplary embodiment, mechanical acoustic barriers 104*a* and 104*b* fill the remaining space in mouth area 106 not already filled by waveguide 103. In one exemplary embodiment, mechanical acoustic barriers 104*a* and 104*b* extend from the front of waveguide 103 (distal to speaker transducer 102) to the back of waveguide 103 (in proximity of speaker transducer 102). In an exemplary alternative embodiment, 104*a* and 104*b* extend partially from the front to the back of waveguide 103.

In one exemplary embodiment, mechanical acoustic barriers 104*a* and 104*b* comprise an open-cell foam material that acts as a barrier to high frequencies (i.e., a low-pass filter that attenuates high frequencies). In an alternative exemplary embodiment, mechanical acoustic barriers 104*a* and 104*b* comprise a closed-cell foam material that acts as a low-pass filter that attenuates high frequencies. In yet another alternative embodiment, mechanical acoustic barriers 104*a* and 104*b* comprise a combination of open-cell and closed-cell foam materials that act as a low-pass filter that attenuates high frequencies. If an open-cell foam material is used, the suitable pores per inch (ppi) range from about 60 ppi to about 120 ppi at a thickness selected to be restrictive to high frequencies, yet non-restrictive to lower frequencies and thereby avoiding "cavity effects" in the space filled by the mechanical acoustic barrier in mouth area 106. The more porous the mechanical barrier, the less high frequencies are attenuated by the mechanical barrier, thereby creating destructive interference patterns and narrowing high frequency dispersion. In another embodiment, mechanical acoustic barriers 104 could be formed by a combination of open- and closed-cell foam materials.

Figure 2A:
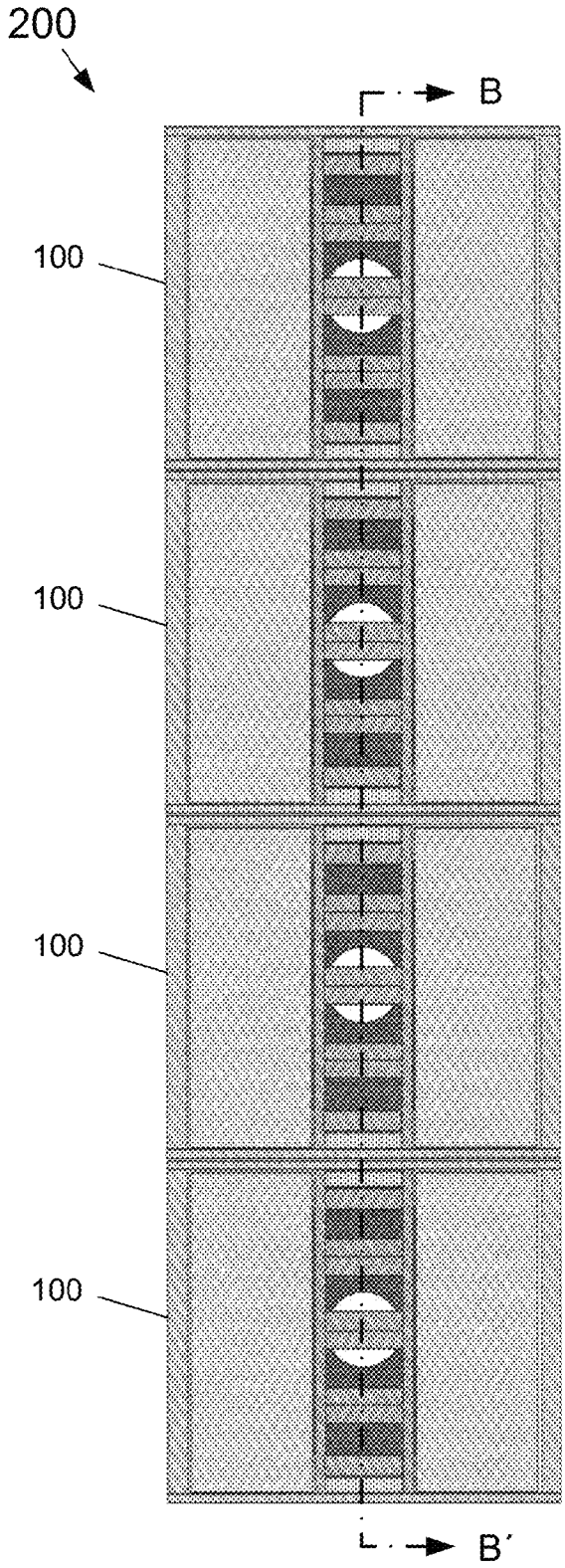
FIG. 2A depicts a front view of an exemplary embodiment of a speaker system that comprises a straight stacked array of four speaker systems according to the subject matter disclosed herein.
Figure 2B:
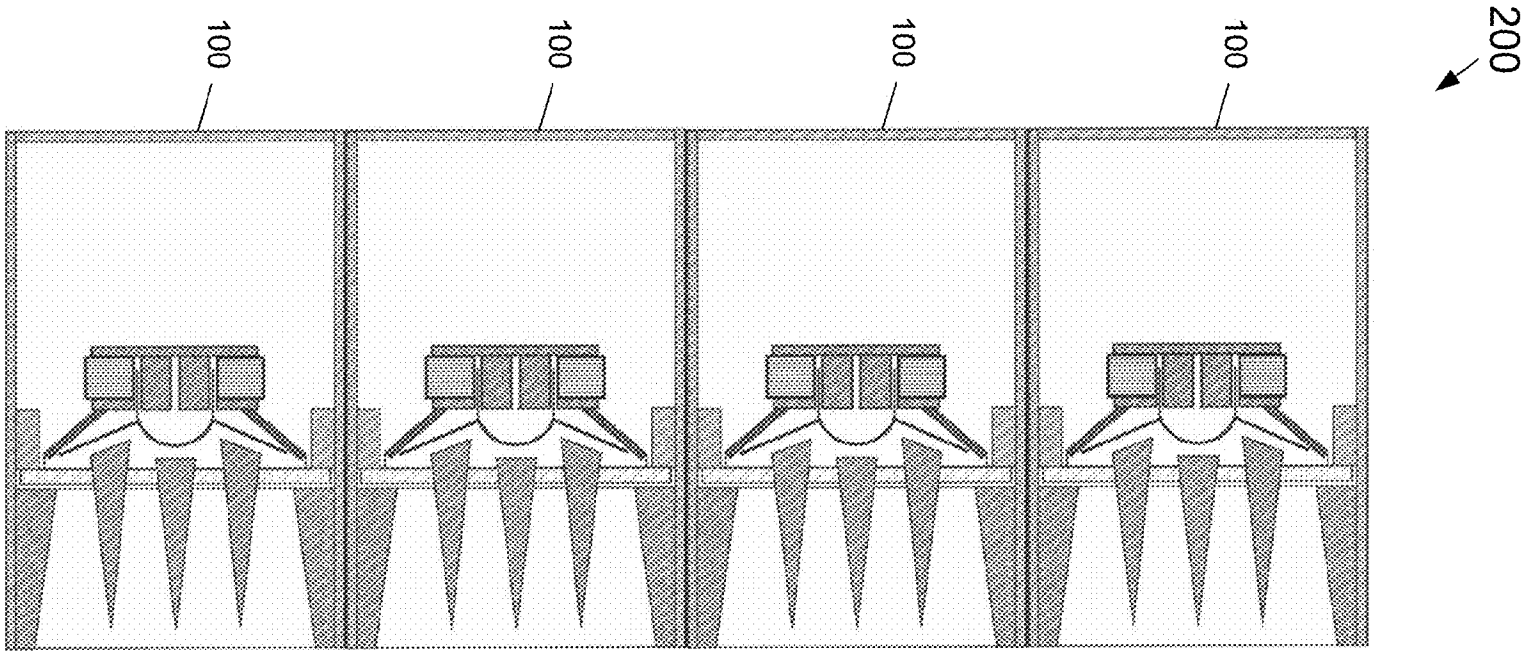
FIG. 2B depicts a side cross-sectional view of the exemplary embodiment of speaker system depicted in FIG. 2A taken along line B-B' in FIG. 2A.

FIG. 2A depicts a front view of an exemplary embodiment of a speaker system 200 that comprises four speaker systems 100 in a straight stacked array. FIG. 2B depicts a side cross-sectional view of the exemplary embodiment of speaker system 200 taken along line B-B' in FIG. 2A. Although FIGS. 2A and 2B depict four speaker systems 100 in a straight stacked array, the claimed subject matter is not so limited and any number of speaker systems 100 could be stacked to form a straight stacked array. Additionally, it should be understood that the subject matter disclosed herein could be used to form a curved stacked array.

Although the foregoing disclosed subject matter has been described in some detail for purposes of clarity of understanding, it will be apparent that certain changes and modifications may be practiced that are within the scope of the appended claims. Accordingly, the present embodiments are to be considered as illustrative and not restrictive, and the subject matter disclosed herein is not to be limited to the details given herein, but may be modified within the scope and equivalents of the appended claims.

What is claimed is:

1. A speaker system, comprising:

a speaker transducer comprising a diameter and a vertically oriented centerline;

a diffraction-slot acoustic waveguide comprising a first side, a second side, a third side and a fourth side, the first and second sides each comprising a first length and extending in a first direction that is substantially parallel to the centerline of the speaker transducer, the first and second sides being arranged opposite from each other, the third and fourth sides each comprising a second length and extending in a second direction that is substantially perpendicular to the centerline of the speaker transducer, the third and fourth sides being arranged opposite from each other, an area of the waveguide being defined by the first length and the second length, the waveguide being arranged in proximity to the speaker transducer along the centerline of the speaker transducer so that the third and fourth sides extend substantially an equal distance on both sides of the centerline of the speaker transducer, the area of the waveguide covering a corresponding area of the speaker transducer; and first and second mechanical acoustic barriers each comprising a length, a width and an area defined by the length and the width of the mechanical acoustic barrier, the length of each mechanical acoustic barrier extending in the first direction and the width of each mechanical barrier extending in the second direction, the first mechanical acoustic barrier being disposed adjacent to the first side of the waveguide so that the length of the first mechanical acoustic barrier corresponds to the length of the first side, the second mechanical acoustic barrier being disposed adjacent to the second side of the waveguide so that the length of the second mechanical acoustic barrier corresponds to the length of the second side, the respective areas of the first and second mechanical acoustic barriers covering the areas of the speaker transducer on both sides of the centerline of the speaker transducer that are not covered by the waveguide, and the first and second mechanical acoustic barriers providing a low-pass filter for acoustic energy output from the speaker transducer.

2. The speaker system according to claim 1, wherein the waveguide further comprises a third length extending in a third direction away from the speaker transducer, wherein the third direction is substantially perpendicular to the first and second directions, and wherein the third length of the waveguide is greater than or equal to one half of the quantity of the speaker transducer diameter minus the second length.

3. The speaker system according to claim 1, wherein the waveguide further comprises a third length extending in a third direction away from the speaker transducer, wherein the third direction is substantially perpendicular to the first and second directions, and wherein the third length of the waveguide is greater than or equal to about 1½ inches.

4. The speaker system according to claim 3, wherein the diameter of the speaker transducer comprises about 4 inches.

5. The speaker system according to claim 4, wherein the first and second mechanical acoustic barriers each comprise a foam material comprising between about 60 pores per inch (ppi) and about 120 ppi.

6. The speaker system according to claim 1, wherein the first and second mechanical acoustic barriers each comprise a foam material comprising between about 60 pores per inch (ppi) and about 120 ppi.

7. The speaker system according to claim 1, further comprising a second speaker transducer a diameter and a centerline that is substantially aligned with the vertically oriented centerline;

a second diffraction-slot acoustic waveguide comprising a first side, a second side, a third side and a fourth side, the first and second sides each comprising the first length and extending in the first direction that is substantially parallel to the centerline of the second speaker transducer, the first and second sides being arranged opposite from each other, the third and fourth sides each comprising the second length and extending in the second direction that is substantially perpendicular to the centerline of the second speaker transducer, the third and fourth sides being arranged opposite from each other, an area of the second waveguide being defined by the first length and the second length, the second waveguide being arranged in proximity to the second speaker transducer along the centerline of the second speaker transducer so that the third and fourth sides extend substantially an equal distance on both sides of the centerline of the second speaker transducer, the area of the second waveguide covering a corresponding area of the second speaker transducer; and third and fourth mechanical acoustic barriers each comprising a length, a width and an area defined by the length and the width of the mechanical acoustic barrier, the length of each of the third and fourth mechanical acoustic barriers extending in the first direction and the width of each of the third and fourth mechanical barriers extending in the second direction, the third mechanical acoustic barrier being disposed adjacent to the first side of the second waveguide so that the length of the third mechanical acoustic barrier corresponds to the length of the first side of the second waveguide, the fourth mechanical acoustic barrier being disposed adjacent to the second side of the second waveguide so that the length of the fourth mechanical acoustic barrier corresponds to the length of the second side of the second waveguide, the respective areas of the third and fourth mechanical acoustic barriers covering areas of the second speaker transducer on both sides of the centerline of the second speaker transducer that are not covered by the second waveguide, and the third and fourth mechanical acoustic barriers providing a low-pass filter for acoustic energy output from the speaker transducer.

8. The speaker system according to claim 7, wherein the second waveguide further comprises a third length extending in the third direction away from the second speaker transducer, and the third length of the second waveguide is greater than or equal to about 1½ inches.

9. The speaker system according to claim 8, wherein the diameter of the second speaker transducer comprises about 4 inches.

10. The speaker system according to claim 9, wherein the third and fourth mechanical acoustic barriers each comprise a foam material comprising between about 60 pores per inch (ppi) and about 120 ppi.

11. A speaker system, comprising:

a speaker transducer comprising a diameter and a vertically oriented centerline; and a diffraction-slot acoustic waveguide comprising a first exterior side, a second exterior side, a third exterior side and a fourth exterior side, the first and second exterior sides each comprising a first length and extending in a first direction that is substantially parallel to the centerline of the speaker transducer, the first and second exterior sides being arranged opposite from each other, the third and fourth exterior sides each comprising a second length and extending in a second direction that is substantially perpendicular to the centerline of the speaker transducer, the third and fourth exterior sides being arranged opposite from each other, an area of the waveguide being defined by the first, second, third and fourth exterior sides, the waveguide being arranged in proximity to the speaker transducer along the centerline of the speaker transducer so that the third and fourth exterior sides extend substantially an equal distance on both sides of the centerline of the speaker transducer, the area of the waveguide covering a first area of the speaker transducer and leaving uncovered a second area of the speaker transducer, the waveguide further comprising a third length extending in a third direction away from the speaker transducer, the third direction being substantially perpendicular to the first and second directions, and the third length of the waveguide being greater than or equal to one half of the quantity of the speaker transducer diameter minus the second length.

12. The speaker system according to claim 11, wherein the third length of the waveguide is greater than or equal to about 1½ inches.

13. The speaker system according to claim 12, wherein the diameter of the speaker transducer comprises about 4 inches.

14. The speaker system according to claim 11, further comprising:

first and second mechanical acoustic barriers each comprising a length, a width and an area defined by the length and the width of the mechanical acoustic barrier, the length of each mechanical acoustic barrier extending in the first direction and the width of each mechanical barrier extending in the second direction, the first mechanical acoustic barrier being disposed adjacent to the first exterior side of the waveguide so that the length of the first mechanical acoustic barrier corresponds to the length of the first exterior side, the second mechanical acoustic barrier being disposed adjacent to the second exterior side of the waveguide so that the length of the second mechanical acoustic barrier corresponds to the length of the second exterior side, the respective areas of the first and second mechanical acoustic barriers covering areas of the speaker transducer on both sides of the centerline of the speaker transducer that are not covered by the waveguide, and the first and second mechanical acoustic barriers providing a low-pass filter for acoustic energy output from the speaker transducer.

15. The speaker system according to claim 14, wherein the first and second mechanical acoustic barriers each comprise a foam material comprising between about 60 pores per inch (ppi) and about 120 ppi.

16. A speaker system, comprising:

a plurality of speaker transducers each comprising a diameter and a centerline oriented along a mutual centerline of the respective speaker transducers;

a plurality of diffraction-slot acoustic waveguide each corresponding to a speaker transducer, each waveguide comprising:

a first side, a second side, a third side and a fourth side, the first and second sides each comprising a first length and extending in a first direction that is substantially parallel to the mutual centerline of the speaker transducers, the first and second sides being arranged opposite from each other, the third and fourth sides each comprising a second length and extending in a second direction that is substantially perpendicular to the mutual centerline of the speaker transducers, the third and fourth sides being arranged opposite from each other, an area of the waveguide being defined by the first length and the second length, the waveguide being arranged in proximity to the corresponding speaker-transducer diaphragm along the mutual centerline of the speaker transducer so that the third and fourth sides extend substantially an equal distance on both sides of the mutual centerline of the speaker transducer, the area of the waveguide covering a corresponding area of the corresponding speaker transducer; and a plurality of first and second mechanical acoustic barriers, each first and second mechanical acoustic barrier corresponding to a speaker transducer and comprising:

a length, a width and an area defined by the length and the width of the mechanical acoustic barrier, the length of each first and second mechanical acoustic barrier extending in the first direction and the width of each mechanical barrier extending in the second direction, the first mechanical acoustic barrier being disposed adjacent to the first side of the corresponding waveguide so that the length of the first mechanical acoustic barrier corresponds to the length of the first side, the second mechanical acoustic barrier being disposed adjacent to the second side of the corresponding waveguide so that the length of the second mechanical acoustic barrier corresponds to the length of the second side, the respective areas of the first and second mechanical acoustic barriers covering areas of the speaker transducer on both sides of the mutual centerline of the speaker transducer that are not covered by the corresponding waveguide, and the first and second mechanical acoustic barriers providing a low-pass filter for acoustic energy output from the corresponding speaker transducer.

17. The speaker system according to claim 16, wherein each waveguide further comprises a third length extending in a third direction away from the corresponding speaker transducer, wherein the third direction is substantially perpendicular to the first and second directions, and wherein the third length of the waveguide is greater than or equal to about 1½ inches.

18. The speaker system according to claim 17, wherein the diameter of each speaker transducer comprises about 4 inches.

19. The speaker system according to claim 18, wherein each first and second mechanical acoustic barrier comprises a foam material comprising between about 60 pores per inch (ppi) and about 120 ppi.

20. The speaker system according to claim 16, wherein each first and second mechanical acoustic barrier comprises a foam material comprising between about 60 pores per inch (ppi) and about 120 ppi.

* * * * *

UNITED STATES PATENT AND TRADEMARK OFFICE

CERTIFICATE OF CORRECTION

PATENT NO. : 9,282,398 B2
APPLICATION NO. : 14/219656
DATED : March 8, 2016
INVENTOR(S) : Dana Monroe It is certified that error appears in the above-identified patent and that said Letters Patent is hereby corrected as shown below:

Claims

In claim 7, line 3, please insert --comprising-- between “transducer” and “a diameter”.

Signed and Sealed this
Tenth Day of May, 2016

Michelle K. Lee

Michelle K. Lee
*Director of the United States Patent and Trademark Office*